US010113792B2

(12) United States Patent
Rauch et al.

(10) Patent No.: US 10,113,792 B2
(45) Date of Patent: Oct. 30, 2018

(54) AIR SEPARATION APPARATUS

(71) Applicants: Jeremiah J. Rauch, Clarence Center, NY (US); Catherine B. Sarigiannis, Grand Island, NY (US); Andrew M. Warta, Wheatfield, NY (US); Sophia J. Dowd, Grand Island, NY (US)

(72) Inventors: Jeremiah J. Rauch, Clarence Center, NY (US); Catherine B. Sarigiannis, Grand Island, NY (US); Andrew M. Warta, Wheatfield, NY (US); Sophia J. Dowd, Grand Island, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 275 days.

(21) Appl. No.: 15/292,856

(22) Filed: Oct. 13, 2016

(65) Prior Publication Data

US 2017/0030643 A1 Feb. 2, 2017

Related U.S. Application Data

(62) Division of application No. 13/726,679, filed on Dec. 26, 2012, now Pat. No. 9,518,778.

(51) Int. Cl.
*F25J 3/04* (2006.01)

(52) U.S. Cl.
CPC ..... *F25J 3/04781* (2013.01); *F25J 3/0409* (2013.01); *F25J 3/04024* (2013.01);
(Continued)

(58) Field of Classification Search
CPC ..... F25J 3/04; F25J 3/04824; F25J 3/04781; F25J 3/04812; F25J 3/04024;
(Continued)

(56) References Cited

U.S. PATENT DOCUMENTS 3,477,239 A 11/1969 Rische
4,861,351 A 8/1989 Nicholas et al.
(Continued)

FOREIGN PATENT DOCUMENTS

CN 102192637 9/2011
EP 0 880 000 A2 11/1998
(Continued)

*Primary Examiner* — Frantz Jules
*Assistant Examiner* — Webeshet Mengesha
(74) *Attorney, Agent, or Firm* — Robert J. Hampsch; David M. Rosenblum

(57) ABSTRACT

A method and apparatus for separating air in which production of the liquid products can be selectively varied between high and low production rates by varying the pressure ratio across a turboexpander used in imparting refrigeration with the use of a branched flow path. The branched flow path has a system of valves to selectively and gradually introduce a compressed refrigerant air stream into either a booster compressor branch having a booster compressor to increase the pressure ratio during high modes of liquid production or a bypass branch that bypasses the booster compressor to decrease the pressure ratio during low modes of liquid production. A recycle branch is connected to the booster compressor branch to allow compressed air to be independently recycled from the outlet to the inlet of the booster compressor during turndown from the high to the low liquid mode of liquid production to prevent surge.

10 Claims, 4 Drawing Sheets

(52) U.S. Cl.
CPC ..... *F25J 3/04175* (2013.01); *F25J 3/04296* (2013.01); *F25J 3/04412* (2013.01); *F25J 3/04812* (2013.01); *F25J 3/04824* (2013.01); *F25J 2220/40* (2013.01); *F25J 2230/40* (2013.01); *F25J 2240/42* (2013.01)

(58) Field of Classification Search
CPC .. F25J 3/04175; F25J 3/04296; F25J 3/04412; F25J 3/0409; F25J 3/04769; F25J 3/04836; F25J 2230/24; F25J 2230/30; F04D 27/0207
See application file for complete search history.

(56) References Cited

U.S. PATENT DOCUMENTS

| | | | |
|---|---|---|---|
| 5,901,579 | A | 5/1999 | Mahoney et al. |
| 9,279,613 | B2 | 3/2016 | Howard |
| 9,441,878 | B2 | 9/2016 | Howard |
| 2009/0241595 | A1 | 10/2009 | Chinta et al. |
| 2012/0131951 | A1 | 5/2012 | Myobatake et al. |
| 2013/0170952 | A1 | 7/2013 | Brenne et al. |
| 2014/0230430 | A1 | 8/2014 | Krug et al. |

FOREIGN PATENT DOCUMENTS

| | | | |
|---|---|---|---|
| EP | 1 186 844 | A2 | 3/2002 |
| EP | 1 586 838 | A1 | 10/2005 |
| JP | H 02275282 | A | 11/1990 |
| WO | 2008/070757 | A1 | 6/2008 |

AIR SEPARATION APPARATUS

CROSS REFERENCE TO RELATED APPLICATIONS

The present application is a divisional application that claims the benefit of and priority to pending U.S. patent application Ser. No. 13/726,679 filed on Dec. 26, 2012.

FIELD OF THE INVENTION

The present invention relates to an air separation method and apparatus in which refrigeration is imparted to an air separation plant by forming a compressed refrigerant air stream from compressed and purified air, expanding the compressed refrigerant air stream in a turboexpander to produce an exhaust stream and introducing the exhaust stream into a distillation column system that produces one or more liquid products. More particularly, the present invention relates to such a method and apparatus in which the compressed refrigerant air stream is further compressed by a booster compressor prior to expansion to increase the refrigeration and production of the liquid products or bypasses the booster compressor to decrease the refrigeration and production of the liquid products.

BACKGROUND OF THE INVENTION

Air is separated in air separation plants that employ cryogenic rectification to separate the air into products that include nitrogen, oxygen and argon. In such plants, the air is compressed, purified of higher boiling contaminants such as carbon dioxide and water, cooled to a temperature suitable for the distillation of the air and then introduced into a distillation column system.

In one typical distillation column system, the air is separated in a higher pressure column into a nitrogen-rich vapor column overhead and a crude liquid oxygen column bottoms, also known as kettle liquid. A stream of the crude liquid oxygen column bottoms is introduced into a lower pressure column for further refinement into an oxygen-rich liquid column bottoms and a nitrogen-rich vapor column overhead. The lower pressure column operates at a lower pressure than the higher pressure column and is thermally linked to the higher pressure column by a heat exchanger known as a condenser reboiler. The condenser reboiler condenses a stream of the of the nitrogen-rich vapor column overhead through indirect heat exchange with the oxygen-rich liquid column bottoms to produce liquid nitrogen reflux for both the higher and lower pressure columns and to create boilup in the lower pressure column by vaporization of part of the oxygen-rich liquid column bottoms produced in such column.

In any type of air separation plant, liquid and vapor that can be composed of nitrogen-rich and oxygen-rich liquid and vapor are introduced into a main heat exchanger and passed in indirect heat exchange with the incoming air to help cool the air and to be taken as products from the warm end of the main heat exchanger. In addition, liquid products enriched in oxygen, nitrogen or both can be taken from the distillation column system as liquid products. Also, all or a portion of liquid streams removed from columns can be pumped to produce a pumped or pressurized liquid which is heated in the main heat exchanger or a separate heat exchanger designed to operate at high pressure and produce a enriched products as either a vapor or a supercritical fluid.

Since an air separation plant must be maintained at cryogenic temperatures in order to allow the air to be distilled, refrigeration must be imparted to the plant in order to compensate for heat leakage into the plant and warm end losses from the main heat exchanger or other heat exchanger operated in association therewith. Further, the removal of liquid products will also remove imparted refrigeration that must also be compensated through introduction of refrigeration into the plant. This is commonly done by forming a compressed refrigerant air stream by introducing the compressed and purified air into a booster compressor. The compressed refrigerant air stream after such further compression is then introduced, either directly or after partially cooling such stream, into a turboexpander to produce an exhaust stream that is introduced into the distillation column system. In this regard, such exhaust stream can be introduced into the lower pressure column or the higher pressure column.

In large part, the ongoing expense in operating an air separation plant is the cost of electricity that is consumed in compressing the air. As mentioned above, when liquid is to be taken as a product, further compression will be required to generate the refrigeration that will be required when such products are produced. However, the demand for liquid products and the cost of electricity are not constant. For instance, the cost of electricity and the liquid demand will often be less during evening hours as compared with daylight electricity costs and liquid demands. Consequently, air separation plants can be designed to cyclically produce a greater share of liquid products when electricity is less expensive, store such liquid products and then reduce the production of liquid during daylight hours.

Air separation plants that are designed to be able to produce liquid products at both high and low rates of liquid production are well known in the art. Generally speaking, such plants employ a bypass line that bypasses the booster compressor. When it is desired to produce liquid products at a lower rate, valves route the flow that would otherwise be introduced into the booster compressor in the bypass line. The bypassing of the booster compressor will decrease the pressure ratio across the turboexpander and therefore, the amount of refrigeration able to be imparted to the air separation plant.

However, not all of such plants are able to be cyclically operated between high and low rates of production. For instance, U.S. Pat. No. 5,901,579 discloses a system in which a turbine booster can be bypassed to in turn decrease the pressure ratio across a turbine. However, the arrangement shown in this patent is not capable of being operated in a fashion in which liquid production would be cycled between high and low liquid makes. Such a system can either be set in a high mode of production in which a booster compressor is used or a low mode of production where the booster compressor is bypassed and not used. In the flow circuit shown in this patent, if the booster compressor were bypassed without turning off the plant, the booster compressor would immediately go into surge. Surge, as well known in the art, is a damaging oscillating flow condition within the compressor that is brought about by exceeding the pressure ratio at a specific compressor speed. Also, it would not be possible to gradually take the booster compressor off line because in the flow circuit shown in this patent, the compressed air would reverse its direction and flow into the pre-purification unit.

Even in plants that are designed to be cyclically operated between high and low rates of liquid production, the range of range of liquid production that is able to be realized is very limited. One major reason for this has to do with surge. In order to avoid surge, the bypass line itself is utilized to initially recycle compressed air from the outlet of the compressor to the inlet of the booster compressor when it is brought on line or is taken off line or into a low pressure operating mode. The problem with this is that a valve in the bypass line is used for such purposes and unless the booster compressor has only limited compression capabilities as compared with a plant operation using the bypass, flow to the turboexpander could be disrupted leading to the turboexpander being damaged. Moreover, often the turboexpanders used in such plants are directly coupled to a compressor on a common pinion in an arrangement known as a booster loaded turbine. When pressure is increased by the booster compressor, the speed of the turboexpander and therefore, the coupled compressor will increase to drive the compressor toward surge. As can be appreciated this also limits the compression capabilities of the booster compressor and consequently the variation of pressure ratio that can be applied to the turboexpander. As a result, in such arrangements the degree to which the air separation plant can be turned down to decrease liquid production is very limited. Consequently, the power savings of such a plant during periods at which low liquid production rates are desired is also limited.

As will be discussed, the present invention provides a method of separating air and an air separation plant which among other advantages, allows a booster to by bypassed to turn down liquid production with greater liquid turndown capabilities than are contemplated in the prior art.

SUMMARY

The present invention provides a method of separating air in an air separation plant in which compressed, purified and cooled air is rectified in a distillation column system of the air separation plant that is configured to produce at least one liquid product. Refrigeration is imparted into the air separation plant into with the use of a turboexpander not directly coupled to a single compressor of the air separation plant on a common pinion. The refrigeration is imparted by forming a compressed refrigerant air stream within the air separation plant, expanding the compressed refrigerant air stream in the turboexpander to produce an exhaust stream, and introducing the exhaust stream into the distillation column system of the air separation plant. Production of the at least one liquid product is varied by selectively introducing the compressed refrigerant air stream into either a booster compressor branch of a branched flow path having a booster compressor to further compress the compressed refrigerant air stream and thereby to obtain a higher pressure ratio across the turboexpander and a higher rate of the production or a bypass branch of the branched flow path, bypassing the booster compressor, thereby to obtain a lower pressure ratio across the turboexpander and a lower rate of the production.

The compressed refrigerant air stream is introduced into the booster compressor branch by gradually diverting the compressed refrigerant air stream from the bypass branch to the booster compressor branch, activating the booster compressor and circulating a recycle stream flowing within a recycle branch of the branched flow path from an outlet of the compressor to an inlet of the compressor until booster compressor branch pressure at the outlet of the booster compressor exceeds bypass pressure within the bypass branch whereupon flow of both the recycle stream and the compressed refrigerant air stream within the bypass branch is suspended. The compressed refrigerant air stream is introduced into the bypass branch by gradually diverting the compressed refrigerant air stream from the booster compressor branch to the bypass branch while circulating the recycle stream in the recycle branch until the bypass pressure exceeds the booster compressor branch pressure whereupon the booster compressor is deactivated and flow of both the recycle stream and the compressed refrigerant air stream within the booster compressor branch is suspended. It is to be noted that the terms "activated" and "deactivated" as used herein and in the claims encompass both an operation in which the booster compressor is turned on or off and modes of operating the booster compressor in both a low pressure mode when the booster compressor is deactivated and a high pressure mode when the booster compressor is activated.

Since the turboexpander is not directly coupled to a single compressor of the air separation plant on a common pinion or in other words, is not a booster loaded turbine, one problem of the prior art that would otherwise limit the turndown capability of the air separation plant in the production of liquid products is eliminated in the present invention. Increasing the pressure ratio across the turboexpander will not increase the speed of a compressor to drive the compressor towards surge. The present invention, however, does encompass the arrangement shown in U.S. Pat. No. 5,901,579 in which the work of expansion is dissipated in a bull gear that also drives compressors and that is in turn driven by an electric motor. In such an arrangement, the speeds of the turboexpander and the compressors are constant and will not be varied by the varying the pressure ratio across the turboexpander. Instead, at a constant speed and at a higher pressure ratio across the turboexpander, more expansion work will be dissipated into the bull gear to reduce the power consumed by the electric motor driving the arrangement. However, arrangements is which the speed of the turboexpander are varied are contemplated by the present invention. For example, the turboexpander could be coupled to an electric generator that would dissipate the work of expansion into electricity or an oil brake that would dissipate the work of expansion into heat. Additionally, the other problem of rapidly changing flow to the turboexpander is eliminated because the refrigerant air stream is gradually diverted from the booster compressor branch into the bypass branch where low liquid production rates are desired and is also gradually diverted from the bypass branch into the booster compressor branch when high rates of liquid production are desired. The independent recycle of the recycle stream from the outlet to the inlet of the compressor during such changes in plant operation allow such gradual diversion while at the same time prevent the booster compressor from being driven towards surge. As a consequence a far greater range of turndown can be realized in the present invention as compared with prior art techniques and therefore, a greater degree of power savings.

The compressed refrigerant air stream can be partially cooled in a main heat exchanger used in cooling the air. In such case, the branched flow path is connected to a warm end of the main heat exchanger. In this regard, the term "partially cooled" as used herein and in the claims means cooled to a temperature between the warm and cold ends of the main heat exchanger. Further, the booster compressor is deactivated, a purge air stream, composed of purified air, can be passed through the booster compressor to prevent ambient air from entering the booster compressor.

A liquid stream can be removed from the distillation column system and divided into a first subsidiary liquid stream and a second subsidiary liquid stream. In such case, the at least one liquid product comprises the first subsidiary liquid stream and the second subsidiary liquid stream is heated within the main heat exchanger to form a heated product stream. During the decreasing of production of the at least one liquid product, air flow rate of the air supplied to the air separation plant is decreased to maintain product flow rate of the heated product stream constant. In a specific embodiment of the present invention, the distillation column system can comprise a higher pressure column and a lower pressure column operating at a lower pressure than the higher pressure column, configured to further refine a crude liquid oxygen column bottoms produced in the higher pressure column and connected to the higher pressure column in a heat transfer relationship. This heat transfer connection between high and lower pressure columns is accomplished by condensing a nitrogen-rich vapor column overhead produced in the higher pressure column through indirect heat exchange with an oxygen-rich liquid produced in the lower pressure column, thereby providing liquid nitrogen reflux to the higher pressure column and the lower pressure column. In such case, the liquid stream is an oxygen-rich liquid stream composed of an oxygen-rich liquid column bottoms produced in the lower pressure column. The oxygen-rich liquid stream is divided into the first subsidiary liquid stream and the second subsidiary liquid stream. The second subsidiary liquid stream can be pumped to produce a pressurized liquid product stream and warmed within the main heat exchanger to produce the heated product stream. A further compressed air stream is formed within the air separation plant which is liquefied in the main heat exchanger through indirect heat exchange with the pressurized liquid product stream, thereby to produce a liquid air stream and at least part of the liquid air stream is reduced in pressure and introduced into at least the lower pressure column.

In such specific embodiment, the exhaust stream can be introduced into the higher pressure column. Alternatively, a main air stream formed from part of the air, after having been compressed and purified, is cooled within the main heat exchanger and introduced into the higher pressure column and the exhaust stream is introduced into the lower pressure column. Further, at least part of the air, after having been compressed and purified can be divided into first and second subsidiary steams. The first subsidiary stream is further compressed to form the compressed refrigerant air stream and the second subsidiary stream is further compressed to form the further compressed air stream. Alternatively, at least part of the air, after having been compressed and purified, is further compressed and divided into first and second subsidiary streams. In such case, the first subsidiary stream forms the compressed refrigerant air stream and the second subsidiary stream is further compressed to form the further compressed air stream. In a further alternative, at least part of the air, after having been compressed and purified, is further compressed and divided into first and second subsidiary streams. The first subsidiary stream forms the further compressed air stream and the second subsidiary stream is further compressed to form the refrigerant air stream.

The present invention also provides an air separation apparatus in which an air separation plant is provided with main air compressor, a purification unit connected to the main air compressor, a main heat exchanger in flow communication with the purification unit to cool the air and a distillation column system connected to the main heat exchanger and configured to rectify the air and thereby to produce at least one liquid product. A turboexpander is connected to the distillation column system so that an exhaust stream generated by the turboexpander is introduced into the distillation column system, thereby to impart refrigeration to the air separation plant. The turboexpander is not directly coupled to a single compressor of the air separation plant on a common pinion;

The air separation plant also has a branched flow path positioned between the pre-purification unit and the turboexpander to receive a compressed refrigerant air stream to vary production of the at least one liquid product. The branched flow path has a booster compressor branch including a booster compressor to further compress the compressed refrigerant air stream and thereby obtain a higher pressure ratio across the turboexpander and a higher rate of production and a bypass branch, bypassing the booster compressor, thereby to obtain a lower pressure ratio across the turboexpander and a lower rate of production. A recycle branch connects an outlet of the booster compressor to an inlet of the booster compressor and is connected at opposite ends to the booster compressor branch for flow of a recycle stream from the outlet to the inlet of the booster compressor thereby to prevent surge within the booster compressor. A valve is provided to permit selective introduction of the compressed refrigerant air stream into either the booster compressor branch or the recycle branch.

The system of valves includes a first flow control valve located within the booster compressor branch upstream of the inlet of the booster compressor, a second flow control valve located within the bypass branch and a third valve located in the recycle branch. Additionally, two valves are located in the booster compressor branch and the bypass branch, respectively positioned downstream of the outlet of the compressor and the recycle branch and upstream of the second control valve and configured to prevent a reversal of flow in the booster compressor branch when bypass branch pressure within the bypass branch exceeds that of booster compressor branch and the reversal of flow in the bypass branch when booster compressor branch pressure at the outlet of the booster compressor exceeds that of the bypass branch. A programmable control system is configured to generate control signals to control valve opening of the first flow control valve, the second flow control valve and the third valve and to activate the booster compressor.

The control system is responsive to selective user input to selectively introduce the compressed refrigerant air stream into the booster compressor branch and the bypass branch and is programmed such that, when the compressed refrigerant air stream is introduced into the booster compressor branch, the first flow control valve gradually opens and the second flow control valve gradually closes to gradually divert the compressed refrigerant air stream from the bypass branch to the booster compressor branch and thereby introduce the compressed refrigerant air stream into the booster compressor branch, the booster compressor is activated, the third valve initially is set in an open position to allow flow of the recycle stream and thereafter, is reset from an open position to a closed position when the booster compressor pressure exceeds the bypass pressure. The control system is also programmed such that, when the compressed refrigerant stream is introduced into the bypass branch, the first flow control valve gradually closes and the second flow control valve gradually opens to gradually divert the compressed refrigerant air stream from booster compressor branch to the bypass branch and thereby introduce the compressed refrigerant air stream into the bypass branch, the third valve is reset in from the closed position to the open position and the booster compressor is deactivated when the bypass pressure exceeds the booster compressor branch pressure.

The turboexpander can be positioned between a location of a main heat exchanger having an intermediate temperature between warm and cold ends thereof and the distillation column system. In such case, the branched flow path is positioned between the pre-purification unit and the main heat exchanger upstream of the turboexpander to receive a compressed refrigerant air stream. Further, the branched flow path can have a means for passing a purge air stream, composed of purified air, through the booster compressor after the booster compressor is deactivated to prevent ambient air from entering the booster compressor.

In a specific embodiment of the present invention, a conduit can be provided having an intermediate outlet that connects the distillation column system to the main heat exchanger so that a liquid stream is removed from the distillation column system, is divided into a first subsidiary liquid stream discharged from the intermediate outlet and a second subsidiary liquid stream introduced into the main heat exchanger. The at least one liquid product comprises the first subsidiary liquid stream and the at least on liquid flow control valve is connected to the intermediate outlet. The main heat exchanger is configured to heat the second subsidiary liquid stream to form a heated product stream and the main air compressor has inlet guide vanes that are able to be adjusted to control air flow rate through the main air compressor and thereby decrease the air flow rate during the low mode of production to in turn maintain product flow rate of the heated product stream constant.

In such specific embodiment, the distillation column system can comprise a higher pressure column and a lower pressure column operating at a lower pressure than the higher pressure column, configured to further refine a crude liquid oxygen column bottoms produced in the higher pressure column. The lower pressure column is connected to the higher pressure column in a heat transfer relationship so that a nitrogen-rich vapor column overhead produced in the higher pressure column is condensed through indirect heat exchange with an oxygen-rich liquid produced in the lower pressure column, thereby providing liquid nitrogen reflux to the higher pressure column and the lower pressure column. In such case the liquid stream can be an oxygen-rich liquid stream composed of an oxygen-rich liquid column bottoms produced in the lower pressure column. The oxygen-rich liquid stream is divided into the first subsidiary liquid stream and the second subsidiary liquid stream and a pump is positioned within the conduit to pressurize the second subsidiary liquid stream and thereby to produce a pressurized liquid product stream that is warmed within the main heat exchanger to produce the heated product stream. A means is provided for forming a further compressed air stream is positioned between the pre-purification unit and the main heat exchanger. The main heat exchanger is configured to liquefy the further compressed air stream and thereby form a liquid air stream and also, is in flow communication with at least the lower pressure column to introduce at least part of a liquid air stream into the lower pressure column. An expansion valve is positioned between the main heat exchanger and the lower pressure column to reduce pressure of the at least part of the air stream prior to introduction into the lower pressure column.

In such specific embodiment, the turboexpander can be connected to the higher pressure column such that the exhaust stream is introduced into the higher pressure column. Alternatively, the main heat exchanger can be positioned in flow communication with the pre-purification unit so that part of the air, after having been compressed and purified, is cooled within the main heat exchanger and introduced into the higher pressure column. The turboexpander is connected to the lower pressure column so that the exhaust stream is introduced into the lower pressure column.

First and second booster compressors can be provided in flow communication with the pre-purification unit so that first and second subsidiary streams, formed from at least part of a compressed and purified air stream discharged from the pre-purification unit, are further compressed in the first and second booster compressors, respectively and thereby respectively form the compressed refrigerant stream and the further compressed air stream. In such case, the further compressed air stream forming means is the second booster compressor and the booster compressor within the booster compressor branch is a third booster compressor. In another alternative, a first booster compressor can be provided in flow communication with the pre-purification unit so that at least part of a compressed and purified air stream is further compressed. A second booster compressor and the branched flow path are connected to the first booster compressor so that a first subsidiary stream discharged from the first booster compressor forms the compressed refrigerant air stream. A second subsidiary stream discharged from the first booster compressor is further compressed in the second booster compressor to form the further compressed air stream. In such an embodiment of the present invention, the further compressed air stream forming means is the second booster compressor and the booster compressor within the booster compressor branch is a third booster compressor. In yet a further embodiment of the present invention, the first booster compressor can be in flow communication with the pre-purification unit so that at least part of a compressed and purified air stream is further compressed. A second booster compressor, situated between the first booster compressor and the branched flow path and the main heat exchanger, is in flow communication with the first booster compressor so that a first subsidiary stream discharged from the first booster compressor is further compressed in the second booster compressor and forms the compressed refrigerant air stream and a second subsidiary stream flow to the main heat exchanger and forms the further compressed air stream. In this embodiment, the first compressed air stream forming means is the second booster compressor and the booster compressor within the booster compressor branch is a third booster compressor.

BRIEF DESCRIPTION OF THE DRAWINGS

While the specification concludes with claims distinctly pointing out the subject matter that Applicants regard as their invention, it is believed that the invention will be better understood when taken in connection with the accompanying drawings in which:

DETAILED DESCRIPTION

Figure 1:
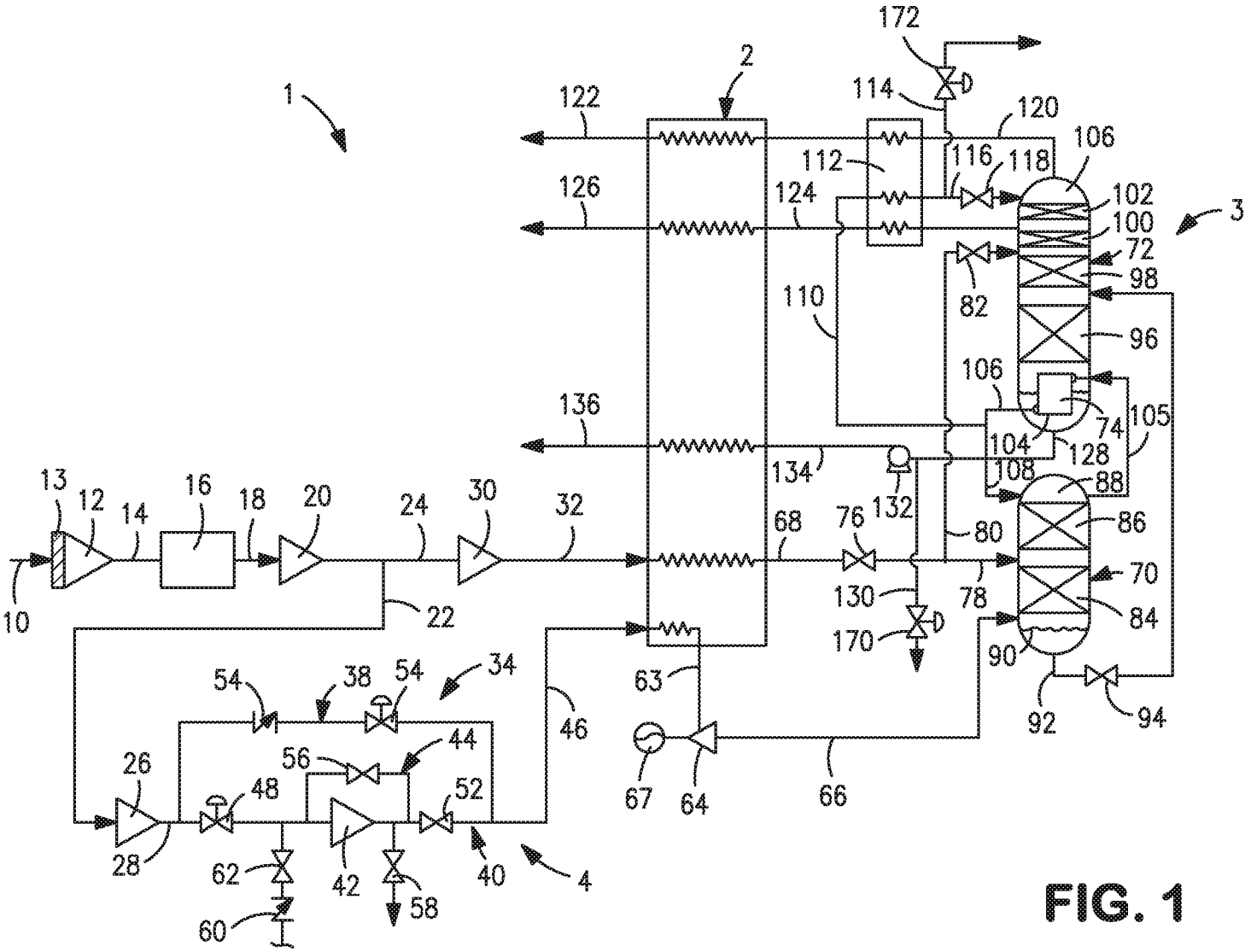
FIG. 1 is a schematic of a process flow diagram of an air separation plant designed to carry out a method in accordance with the present invention.

With reference to FIG. 1, an air separation plant 1 in accordance with the present invention is illustrated. As will be discussed, air separation plant 1 is designed to rectify air by compressing and purifying the feed air stream 10, cooling the resulting compressed and purified air within a main heat exchanger 2 and then distilling the air within a distillation column system 3 to produce liquid oxygen and nitrogen product streams 130 and 114, respectively, as well as a pressurized oxygen product stream 136 and a nitrogen product stream 122 as a vapor. However, this is for exemplary purposes only in that the present invention could be used in connection with an air separation plant designed to produce an argon product that would also be taken as a liquid or other product slates of oxygen and nitrogen. Air separation plant 1 is provided with a bypass system 4 in accordance with the present invention to varying the pressure ratio across a turboexpander 64 and thereby vary the refrigeration imparted to the air separation plant 1 during high and low rates of production of the liquid products.

More specifically, feed air stream 10 is compressed by a main air compressor 12 having inlet guide vanes 13 to produce a compressed air stream 14. Compressed air stream 14 is then introduced into a prepurification unit 16 to produce a compressed and purified air stream 18. As known in the art, the prepurification unit 16 is designed to remove higher boiling impurities from the air such as water vapor, carbon dioxide and hydrocarbons. Such prepurification unit 16 can incorporate adsorbent beds operating in an out of phase cycle that is a temperature swing adsorption cycle or a pressure swing adsorption cycle or combinations thereof.

The compressed and purified air stream 18 is than introduced into a booster compressor 20 and then divided into first and second subsidiary streams 22 and 24. First subsidiary stream is further compressed in a booster compressor 26 of the bypass system 4 to form a compressed refrigerant stream 28 and second subsidiary stream 24 is further compressed in a booster compressor 30 to form a further compressed air stream 32 for purposes that will be discussed hereinafter.

It is to be noted that various arrangements of booster compressors are possible in accordance with the present invention. In this regard, only two booster compressors of the type mentioned above are possible in embodiments of the present invention. For instance, an embodiment is possible in which booster compressor 20 is absent. In such case, a first of the booster compressors 26 further compresses the first subsidiary stream, formed from part of the compressed and purified air stream 18, to produce the compressed refrigerant air stream 28 and a second of the booster compressors 30 further compresses the second subsidiary stream, formed from another part of the compressed and purified air stream 18, to produce the further compressed air stream 32, albeit at a lower pressure than the further compressed air stream 32 discussed above. Another possibility is to delete booster compressor 30. In such case, the compressed and purified air stream 18 would be compressed in a first of the booster compressors, booster compressor 20, the first subsidiary stream would be compressed in a second of the booster compressors, booster compressor 26, to form the compressed refrigerant stream 28 and the second subsidiary stream 24 would be the further compressed air stream. In yet another embodiment, booster compressor 26 would not be present and therefore, the compressed and purified air stream 18 would be compressed in a first of the booster compressors, booster compressor 20, the first subsidiary stream would form the compressed refrigerant stream and the second subsidiary stream 24 would be compressed in a second of the booster compressors to, booster compressor 30 to form the further compressed air stream 32.

As will be discussed, the further compressed air stream 32 is necessary in the illustrated embodiment to heat part of an oxygen-rich liquid stream 128 that is pumped to produce a pressurized liquid product stream 136. However, embodiments of the present invention are possible in which there is no such pressurized product; and therefore, the further compressed air stream 32 would not be necessary. In such case, a possible embodiment could entail the use booster compressor 20 alone to create a compressed refrigerant stream from part of the compressed and purified air stream 18. Another part of the compressed and purified air stream would be introduced into the distillation column system 3 for rectification.

The compressed refrigerant air stream 28 is then introduced into a branched flow path 34 of the bypass system 4 that has a bypass branch 38, a booster compressor branch 40 having a booster compressor 42 and a recycle branch 44. The branched flow path 34 discharges a compressed output stream 46, composed of the compressed refrigerant air stream 28, that has a pressure that is dependent upon whether the compressed refrigerant air stream is introduced into the bypass branch 38 or the booster compressor branch 40. When the refrigerant stream 28 is introduced into the booster compressor branch 40, it is further compressed by booster compressor 42 to further compress the compressed refrigerant stream 28 and thereby allow production of the pressure of compressed output stream 46 at an increase in pressure over that obtained when the compressed refrigerant air stream is introduced into the bypass branch 38. When the compressed refrigerant stream 28 is introduced into the bypass branch 38, the booster compressor 42 is bypassed and therefore, the compressed output stream 46 is at a pressure, less piping and valve losses, that is about equal to that of the incoming compressed refrigerant stream 28 which of course is less than when such stream is further compressed by the booster compressor 42. The recycle branch 44 allows a pressure ratio to be maintained across the booster compressor 42 independently of any redirection of the compressed refrigerant air stream 28 between the bypass branch 38 and the booster compressor branch 40 to prevent the booster compressor 42 from encountering surge operational conditions.

In a manner that will be discussed in more detail hereinafter, diversion of the compressed refrigerant air stream 28 between the booster compressor branch 40 and bypass branch 38 is actively controlled by first and second flow control valves 48 and 50, situated in booster compressor branch 40 and bypass branch 38, respectively and passively by check valves 52 and 54 located in such branches. A third valve 56 in the recycle branch 44 actively controls flow of the recycle stream within the recycle branch 44. Valves 58, 60 and 62 control introduction of flow of a purge stream, composed of purified air, into booster compressor 42 when the same is in a deactivated condition.

The compressed output stream 46 is then introduced into main heat exchanger 2 where it is partially cooled to an intermediate temperature, between temperatures of the warm and cold ends of the main heat exchange to produce a partially cooled stream 63 that is introduced into a turboexpander 64 that generates an exhaust stream 66. Exhaust stream 66 is introduced into distillation column 3 to impart the refrigeration generated by the expansion. As could be appreciated by those skilled in the art, although the compressed output stream 46 is partially cooled within the main heat exchanger 2, in a possible embodiment of the present invention, compressed output stream 46 could bypass the main heat exchanger 2 and be directly introduced into turboexpander 64, in which case the turboexpander 64 would be a warm expander and an additional turboexpander could be provided to impart a base load of refrigeration in or to maintain the air separation plant of such embodiment in heat balance.

In the illustrated embodiment, the work of expansion generated by turboexpander 64 is dissipated in producing electricity by being coupled to an electric generator 67. The pressure ratio across the turboexpander 64 and therefore, the refrigeration generated thereby will be dependent upon the pressure of the compressed output stream 46 which, as described above, is dependent upon whether compressed refrigerant air stream 28 was introduced into bypass branch 38 and is thereby generated at a lower pressure or introduced into booster compressor branch 40 and is thereby generated at a higher pressure. When compressed output stream 46 is at a higher pressure, the pressure ratio across turboexpander 64 will increase to in turn increase the refrigeration generated and the rate at which liquid products are able to be produced. Alternatively, when compressed output stream 46 is at a lower pressure, the pressure ratio across turboexpander 64 will decrease to in turn decrease the refrigeration generated and the rate at which the liquid products are produced.

During both high and low rates of liquid production, the air to be distilled within distillation column system 3 is cooled in main heat exchanger 2. In this regard, the compressed refrigeration air stream 28, after passage through bypass branch 38 or booster compressor branch 40 is partially cooled, as compressed output stream 46, prior to being introduced into the turboexpander 64. The further compressed air stream 32 is fully cooled within the main heat exchanger 2 and is condensed to produce a liquid air stream 68. Main heat exchanger 2 can be of brazed aluminum construction and although illustrated as a single unit, could be a series of such units operated in parallel. Further, banked instruction is also possible in which the high pressure streams, such as further compressed air stream 32 and pumped liquid oxygen stream 134, to be discussed, are subjected to indirect heat exchange within a separate high pressure unit.

Distillation column system 3 has a higher pressure column 70 and a lower pressure column 72 thermally linked in a heat transfer relationship by a condenser reboiler 74 and operating at a lower pressure than the higher pressure column 70. The exhaust stream 66 is introduced into the higher pressure column 70 and the liquid air stream is expanded to a pressure of the higher pressure column by means of an expansion valve 76 and divided into first and second subsidiary liquid air streams 78 and 80. First subsidiary liquid air stream is introduced into the higher pressure column 70 and second subsidiary air stream 80 after expansion in an expansion valve 82 to a pressure of the lower pressure column 72 is introduced into the lower pressure column 72.

Higher pressure column 70 is provided with mass transfer contacting elements 84 and 86, such as structured packing or trays or a combination of packing and trays to contact descending liquid and ascending vapor phases of the air that is introduced into the higher pressure column 70 by means of the first subsidiary liquid air stream 78 and the exhaust stream 66. Due to such contact, as the descending liquid phase will be evermore enriched in oxygen as it descends and the ascending vapor phase will become ever more enriched in nitrogen as it ascends to produce a nitrogen-rich vapor column overhead 88 and a crude liquid oxygen column bottoms 90, also known as kettle liquid. A crude liquid oxygen stream 92 is withdrawn from the higher pressure column 70, valve expanded in expansion valve 94 to the pressure of the lower pressure column 72 and then introduced into the lower pressure column 72 for further refinement. The crude liquid oxygen stream 92 can be subcooled prior to such introduction in an embodiment of the present invention.

The Lower pressure column 72 is also provided with mass transfer contacting elements 96, 98, 100 and 102 to again contact descending liquid and vapor phases to produce an oxygen-enriched liquid column bottoms 104 and a nitrogen-rich vapor column overhead 106. The condenser reboiler 74 partly vaporizes the oxygen-enriched liquid column bottoms 104 through indirect heat exchange with a nitrogen-rich vapor stream 105 composed of the nitrogen-rich vapor column overhead 88 of the higher pressure column 70. The vaporization initiates formation of the ascending vapor phase within the lower pressure column 72 and condenses the nitrogen-rich vapor to produce a nitrogen-rich liquid stream 106. Nitrogen-rich liquid stream 106 is divided into first and second subsidiary nitrogen-rich liquid streams 108 and 110. First subsidiary nitrogen-rich liquid stream 108 is introduced into the top of the higher pressure column 70, as reflux, to initiate formation of the descending liquid phase. Second subsidiary nitrogen-rich liquid stream 110 is then subcooled in a subcooling heat exchanger 112 and optionally divided into a liquid nitrogen product stream 114 and a liquid nitrogen reflux stream 116 that after expansion in valve 118 to a compatible pressure is introduced into the top of the lower pressure column 72 to initiate formation of the descending liquid phase.

A nitrogen-rich vapor stream 120 composed of the nitrogen-rich vapor column overhead 106 is withdrawn from the top of the lower pressure column 72, partly warmed in subcooling heat exchanger 112 and then fully warmed in the main heat exchanger to produce a nitrogen product stream 122. Additionally, a waste nitrogen stream 124 can be removed from the lower pressure column 72, at a level below that at which the nitrogen-rich vapor stream 120 is withdrawn, partly warmed in the subcooling heat exchanger 112 and then fully warmed in the main heat exchanger 2 to form a warmed waste nitrogen stream 126. The warming of such streams in the subcooling heat exchanger 112 provide the indirect heat exchange necessary to subcool the second subsidiary nitrogen-rich vapor stream 110. The further warming of such streams in the main heat exchanger 2 help to cool the incoming air. The warmed waste nitrogen stream 126 can be used to regenerate adsorbents within adsorbent beds of the pre-purification unit 16.

An oxygen-rich liquid stream 128, composed of residual oxygen-rich liquid column bottoms 104, can be removed from the lower pressure column 72 and then divided into a liquid oxygen product stream 130 and a remaining stream is pressurized by a pump 132 to produce a pumped liquid oxygen stream 134. Pumped liquid oxygen stream 134 is then fully warmed in the main heat exchanger 2 to produce a pressurized oxygen product stream 136. Depending upon the degree of pressurization, pressurized oxygen product stream 136 is vaporized in the main heat exchanger or is heated to produce such product stream as a supercritical fluid. The heat exchange for such heating is provided by the further pressurized air stream 32. As can be appreciated, if the oxygen product stream as a vapor were to be taken without further pressurization, the further pressurized air stream 32 would not be necessary at a pressure suitable to provide the necessary heat exchange duty. Also, it is to be mentioned that the liquid oxygen product stream 130 could be the only liquid product taken or the nitrogen liquid product stream 114 could be the only liquid product stream taken. In this regard, if a nitrogen stream were desired at pressure, part of the liquid nitrogen product stream 114 could similarly be pressurized by means of a pump.

Figure 2:
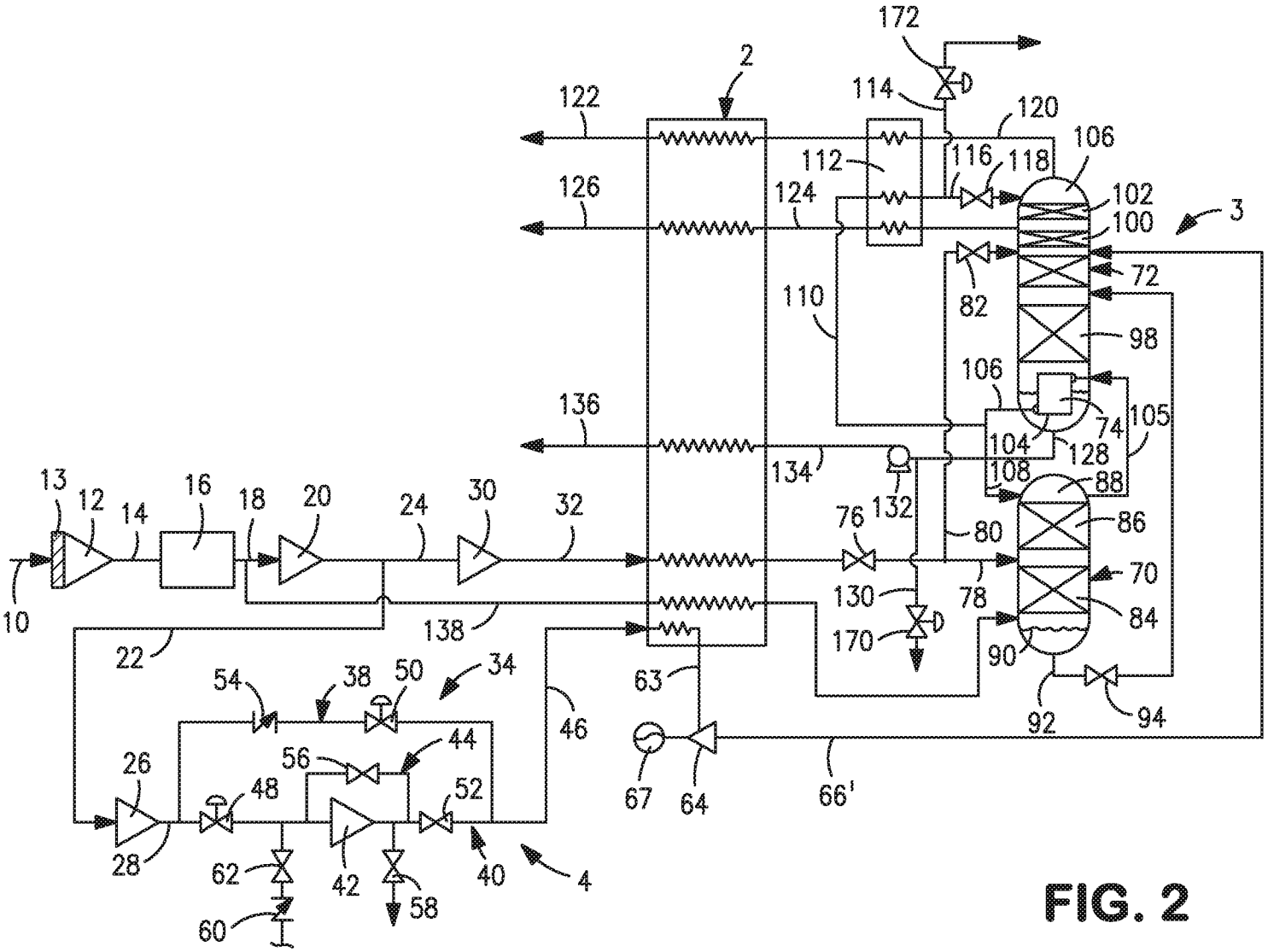
FIG. 2 is an alternative embodiment of FIG. 1.

With brief reference to FIG. 2, in an air separation plant 1', a main air stream 138 formed from part of the compressed and purified air stream 18 is fully cooled within the main heat exchanger 2 and then introduced into the higher pressure column 70. The exhaust stream 66' produced by the turboexpander 36 is introduced into the lower pressure column 72. The description of the features of air separation plant 1' is otherwise the same as those discussed relative to air separation plant 1.

Figure 3:
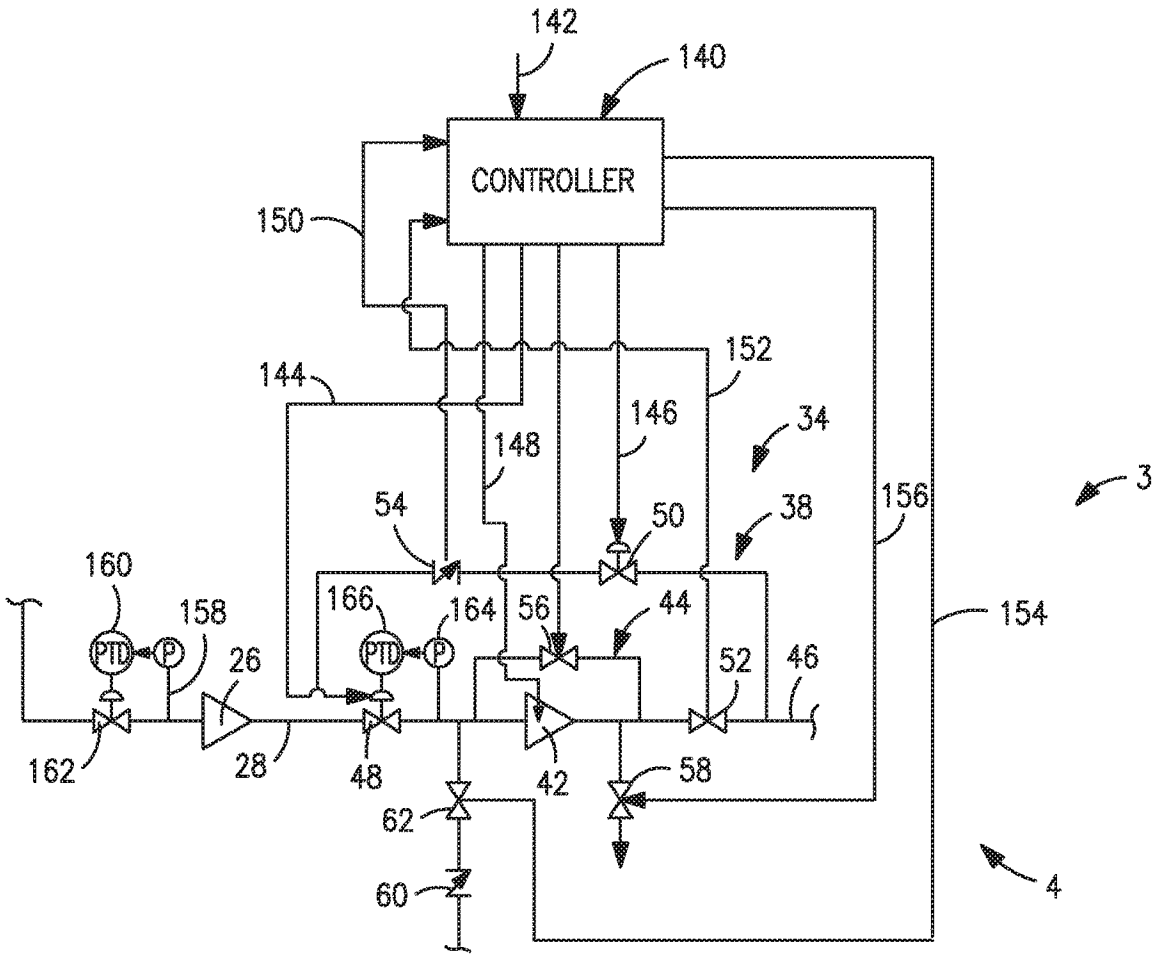
FIG. 3 is a detailed schematic drawing of a control system that is used in controlling a bypass system of the present invention that is used in the air separation plants shown in FIGS. 1 and 2.

As mentioned above, a system of valves is incorporated into the bypass system 4 to control flow within the branches of the branched flow path 34. While manual control is conceivably possible, the control is preferably automated with the use of a controller 140 shown in FIG. 3. Controller 140 could be a programmable logic controller obtainable from a variety of sources or could alternatively be incorporated into the plant control system of the air separation plant 1. Control system 140 is activated by user input 142 to set the plant into modes of production in which the liquid products are produced at higher or lower rates. Control system 140 is designed to control valve operation so that diversion of the compressed refrigerant air stream 28 between the booster compressor branch 40 and the bypass branch 34 is gradual and with independent control of the recycle of the recycle stream within the recycle branch 44, that acts independent of the bypass branch 34, to prevent the booster compressor 42 from entering surge. In turn this allows a far greater range in pressure ratio across the turboexpander 36 than is possible in the prior art and therefore liquid production.

Specifically, when the air separation plant it to be switched from a low liquid rate of production to the high rate of liquid production, first flow control valve 48 is then gradually opened and second control valve 50 within the bypass branch 38 gradually closes to gradually divert the compressed refrigerant stream 28 from the bypass branch 38 to the booster compressor branch 40. It is to be noted that the term "flow control valve" as used herein and in the claims means a valve able to control or meter flow. The control signals for the first and second flow control valves 48 and 50 are transmitted through electrical connections 144 and 146, respectively. In this regard, preferably the opening and closing times should be about 5 seconds. As such ramp functions are programmed into the controller 140 to accomplish the opening and closing of such flow control valves. As could be appreciated by those skilled in the art, a certain degree of tuning would be required in practice to completely perfect such ramp functions. Preferably, a purge stream, composed of purified air, has been introduced into the booster compressor 42 previous to the diversion of the compressed refrigerant stream 28 to the booster compressor branch 40. In order to end the introduction of the purge stream, valve 58 is set in the closed position and check valve 60 closes under the increased pressure within the booster compressor branch 40. Thereafter, a valve 62 is set in the closed position. The control system 140 then activates booster compressor 42 through electrical connection 148. During the previous time at which the compressed refrigerant air stream has been diverted to bypass branch 38, third valve 56 was set in the open position. However, even in an embodiment in which the third valve 56 is in a closed position, it would be reset in an open position. This allows compressed gas from the compressed refrigerant air stream 28 to flow from the outlet of the booster compressor 42 to the inlet thereof and thereby prevent surge. When the booster compressor branch pressure, within the booster compressor branch 40, exceeds the bypass branch pressure, within the bypass branch 38, check valve 54 closes to prevent the flow from reversing in the booster compressor branch 38. At the same time, a valve 52 opens. This can be automatic and therefore, valve 52 can be a check valve. It of course, can also be a remotely activated valve that is activated upon the closing of check valve 54. Check valve 54 could of course also be a remotely activated valve. At this point, second flow control valve 50 can preferably be set in a closed position and third valve 56 in the bypass branch 44 is reset into the closed position. This reset occurs from check valve 54 closing and valve 52 opening and the position of such valves being sensed by the controller 140 through electrical connections 150 and 152. Although not illustrated, turboexpander 36 can be provided with inlet guide vanes to allow the turboexpander 36 to be adjusted for stable operation.

When air separation plant is to be switched from the high rate of liquid production to the low rate of liquid production, compressed refrigerant air stream 28 is gradually diverted from the booster compressor branch 40 to the bypass branch 38. To such end, second control valve 56 is gradually opened to gradually increase flow of the compressed refrigerant air stream 28 into the bypass branch 34. At the same time, first flow control valve 48 gradually closes to gradually decrease the flow of the compressed refrigerant air stream 28 within the booster compressor branch 44. At the same time, the third valve 56 in the bypass branch is commanded to open by controller 140 to allow the flow of a recycle stream within the recycle branch 44 from the outlet to the inlet of the booster compressor 42 to prevent surge. Once the bypass branch pressure exceeds the booster compressor branch pressure check valve 54 opens, valve 52 closes, controller 140 closes valve 56 and booster compressor 42 is deactivated. As mentioned above, the term "deactivated" as used herein and in the claims encompasses either an operation in which booster compressor 42 is turned off or it is set in a low pressure mode of operation. In the low pressure mode of operation the power is reduced and the compressor operates at a very low inlet pressure and at a reduced mass flow rate. In addition to recycle, the low pressure mode of operation would require suitable adjustment of inlet guide vanes to the compressor. In any event, turning off the booster compressor 42 or setting it in a low pressure mode will result in less electricity being consumed during turndown of liquid production.

At this point, the purge air stream is introduced into booster compressor 42 to prevent the entry of untreated air. The problem with ambient air entry into the booster compressor 42 is that the ambient air has not been purified of the higher boiling contaminants; and without such system, the higher boiling contaminants could enter the main heat exchanger 2 and the distillation column 3 and solidify. The purge air stream is composed of purified air and may be obtained from a bleed stream from an operating compressor that is also used in supplying instrument air to air separation plant. In this regard, as known in the art, booster compressor 42 can be provided with labyrinth seals that surround the outer portion of the compressor impeller to prevent high pressure air from escaping from such region. In such an arrangement, a balance of forces acting on the impeller of the compressor is obtained by balancing compressor eye side forces at the inlet of the compressor and forces acting at the back side of the impeller. The forces on the back side of the impeller are produced by high pressure compressed air acting at an outer, annular region of the impeller, outbound of the labyrinth seals, and at an inner circular region of the back side of the impeller, inbound of the labyrinth seals, by providing air from the inlet of the compressor to such inner region of the impeller. Assuming that the booster compressor 42, when deactivated, is operated in the low pressure mode the pressure at the inlet of the booster compressor 42 will be low, typically about 5 psia. When first flow control valve 48 is set in a fully closed position, check valve 60 opens due to such low pressure and the slightly higher pressure of the instrument air. At this point, valve 62 is set in an open position through control action effectuated through an electrical connection 154 between valve 62 and controller 140. Thereafter, valve 58 is reset into an open position by means of an electrical connection 156 between controller 140 and valve 58. The purge air stream simply escapes from the labyrinth seals to the interior of the compressor and through the volute to the outlet of the compressor to prevent ambient air from entering the booster compressor 42. In lieu of such an operation, it also is possible for the purge air stream to simply escape from the outlet of the compressor and be discharged through valve 58.

As can be appreciated, the density of air entering air separation plant 1 will vary due to such factors as temperature and humidity. However, it is important that turboexpander 64 be exposed to specific pressure ratios during both high and low liquid rates of production and incoming pressure will have an effect on the pressure of compressed refrigerant air stream 28 and therefore, such pressure ratios. Preferably in order to compensate for variation in air density, the pressure of the compressed output stream 46 can be controlled to in turn control such pressure ratios. The pressure of the compressed refrigerant air stream 28 is regulated by means of a pressure sensor 158 that generates a signal referable to pressure that is sent to a proportional, integral and derivative ("PID") controller 160 that in turn generates a control signal to control the opening of a valve 162 to maintain such pressure at a set point. When first control valve 48 is set in the open position and booster compressor 42 is activated, first control valve 48 can be used to regulate entry pressure into booster compressor 42. To such end, a pressure sensor 164 can be provided to generate a signal referable to pressure that is fed to PID controller 166. PID controller 166 has a preprogrammed set point to adjust the opening of first control valve 48 for such purposes.

In both of the air separation plants described above, during a turndown mode of operation when less liquid is desired, less liquid must be taken. To such end control valves 170 and 172 are provided to control the flow rate of the liquid oxygen and nitrogen product streams 130 and 114, respectively. As can be appreciated if during a turndown mode of production the liquid withdrawal rate of the liquid oxygen and nitrogen products were unchanged, the level of the oxygen-rich liquid column bottoms 104 within the lower pressure column 72 would drop resulting in less boilup in the lower pressure column 74 and less liquid nitrogen reflux in the higher pressure column 70. In this regard, it is preferable to maintain the level of the oxygen-rich liquid column bottoms 104 constant. Therefore, although not illustrated, flow of the liquid could be controlled by local PID controllers reacting to liquid flow and targets set by a master controller for such liquid flow. The master controller would in turn be responsive to a signal from a level detector placed within the lower pressure column 72 to measure the liquid level of the oxygen-rich liquid column bottoms 104. Alternatively, the control could be to reset control valves automatically upon entering high and low modes of liquid production. A yet other alternative is to allow for manual control by plant operation personnel.

As can be appreciated, during the low rate of liquid production, less oxygen and nitrogen molecules as a liquid will be removed from the air separation plant 1. If nothing further is done; and if the flow rate through the main air compressor 12 is maintained at a constant level, the flow rate of the gaseous products will increase such as the pressurized oxygen productions stream 136. However, it is often desired to maintain such stream at a constant flow rate. In such case, the inlet guide vanes 13 of main air compressor 12 can be adjusted to reduce the flow of the incoming feed air stream 10 entering air separation plant 1 to maintain gaseous production at a constant level.

Figure 4:
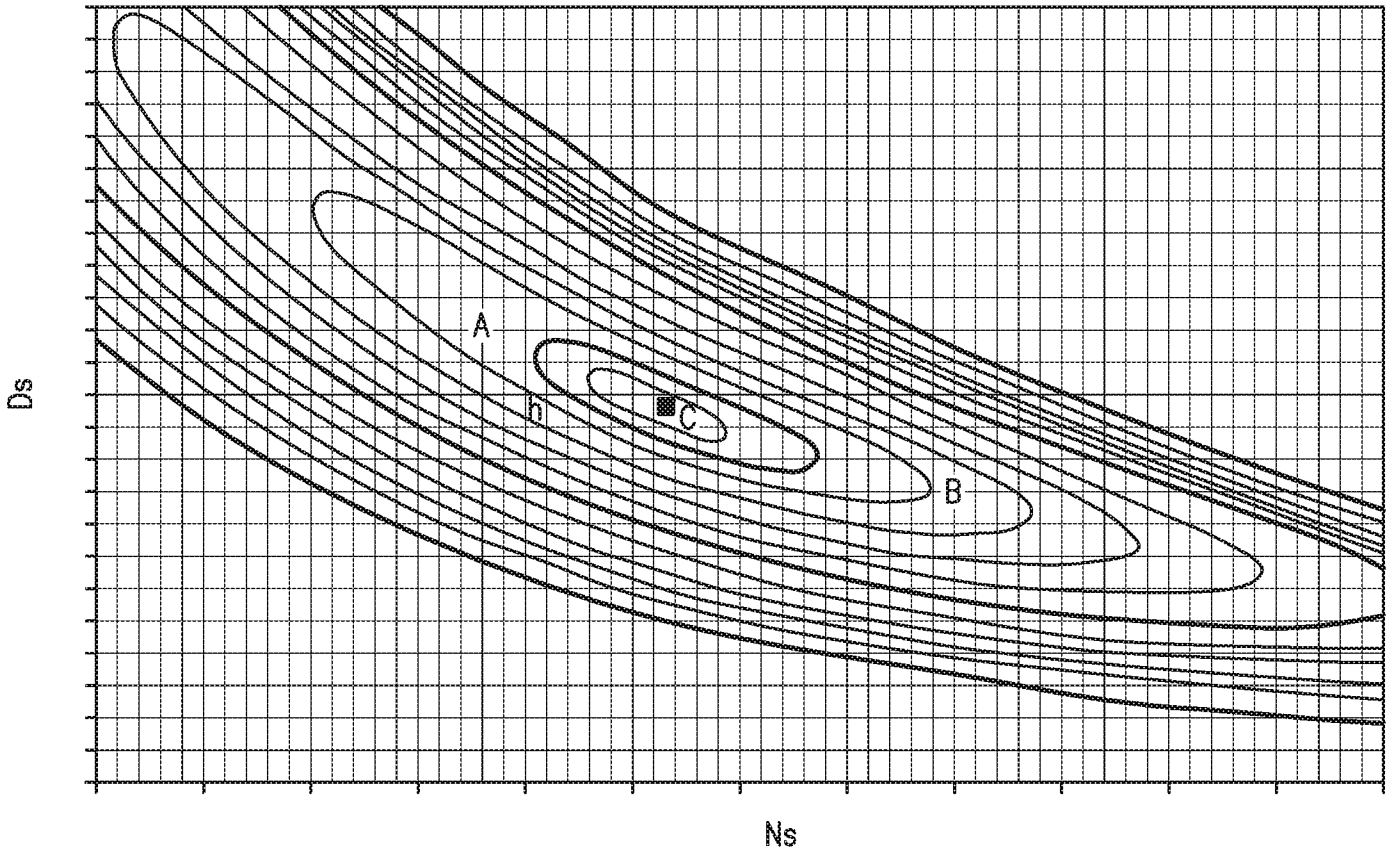
FIG. 4 is a graphical representation of the efficiency of a typical turboexpander on the basis of specific diameter versus specific speed.

With brief reference to FIG. 4, a graphical representation of the efficiency of a typical turboexpander is illustrated as a function of specific speed (Ns) and specific diameter (Ds) with iso-efficiency lines is illustrated. Such a chart illustrates the entire operating range of the turboexpander over a large speed variation, pressure ratio variation and volumetric flow variation. In case of turboexpander 64 or any turboexpander, as turbine inlet pressure changes at constant inlet temperature and constant flow, the volume through the machine increases and the expansion ratio lowers. Typical design practice is to operate the machine near point "C", and thus to maximize the design efficiency. In an air separation plant 1 of the present invention, where the turbine inlet pressure is varied to manipulate the liquid production rates, this is not the ideal choice. Instead, the turboexpander should be designed so that the turboexpander is capable of operating at locations of high liquid production, point "A" and low liquid production, point "B", while maintaining a high efficiency at both points, while not necessarily reaching the peak efficiency in either case. By choosing the points to straddle the ideal efficiency, both points are assured to be in the good rather than ideal efficiency region, minimizing the performance penalty in both high and low liquid rates of production. In this regard, it is preferable that the range between peak efficiency and at either the high or low rates of liquid production is not greater than 5 percent. It is, however, possible to operate air separation plant 1 at a mid pressure ratio between points A and B, at constant mass flow, where the ideal efficiency could be reached. Although the present invention will typically be used in connection with a constant speed booster compressor 42, the present invention also encompasses the use of a variable speed booster compressor at which the peak efficiency will be maintained.

The turboexpander 64 will operate even if the low pressure high volume case has a very poor efficiency. This is due to the nature and thermodynamic favorability of expansion through a turbine as opposed to a compression in a booster. However, across all operating ranges, the turboexpander 64 loading device must be able to absorb the generated power to prevent over speed. This load can be in the form of an electric generator 62, a coupling to a gearbox such as illustrated in U.S. Pat. No. 5,901,579 or to an oil or air brake. However, the work performed by a turboexpander used in connection with the present invention should not be directly dissipated in a single compressor for instance, in a booster loaded turboexpander where a compressor and the turboexpander are mounted on a common pinion. In such case, as the pressure ratio changes across the turboexpander, the speed of turboexpander will change and therefore, the compressor. As a result, the operating range will be narrow because as the speed decreases during period of low liquid production, such compressor will be driven towards surge.

In a turboexpander, such as turboexpander 64 used in connection with the present invention, since the pressure on turboexpander 56 is variable, the turboexpander 64 must take into account the widely varying rotor thrust conditions caused by the variation in eye and tip pressure's on the stages. If this is not controlled, the impeller used in such a device could contact stationary parts, drive gears could be overstressed or other damage could occur. This thrust loading can be alleviated using several different schemes known in the art such as classical thrust bearings able to bear such loads, integral gear thrust collars should the turboexpander 64 be directly mounted on an integral gear machine as shown in U.S. Pat. No. 5,901,579, balance pistons, impeller mounted balance pistons and dry gas seals. It is to be noted that booster compressor 42 would experience similar variability in loading and as such, could incorporate the means discussed above to counter high variable thrust loadings.

While the present invention has been described with reference to preferred embodiments, as will occur to those skilled in the art, numerous changes, additions and omission can be made without departing from the spirit and scope of the invention as set forth in the appended claims.

We claim:

1. An air separation apparatus comprising:

an air separation plant having a main air compressor, a purification unit connected to the main air compressor, a main heat exchanger in flow communication with the purification unit to cool the air, a distillation column system connected to the main heat exchanger and configured to rectify the air and thereby to produce at least one liquid product and a constant speed turboexpander connected to the distillation column system so that an exhaust stream generated by the constant speed turboexpander is introduced into the distillation column system, thereby to impart refrigeration to the air separation plant, the constant speed turboexpander not directly coupled to a single compressor of the air separation plant on a common pinion;

the air separation plant also having a branched flow path positioned between the pre-purification unit and the constant speed turboexpander to receive a compressed refrigerant air stream to vary production of the at least one liquid product and having a booster compressor branch including a constant speed booster compressor to further compress the compressed refrigerant air stream and thereby obtain a higher pressure ratio across the constant speed turboexpander and a higher rate of production, a bypass branch, bypassing the booster compressor, thereby to obtain a lower pressure ratio across the constant speed turboexpander and a lower rate of production, a recycle branch connecting an outlet of the booster compressor to an inlet of the booster compressor and connected at opposite ends to the booster compressor branch for flow of a recycle stream from the outlet to the inlet of the booster compressor thereby to prevent surge within the booster compressor, and a system of valves to permit selective introduction of the compressed refrigerant air stream into either the booster compressor branch or the recycle branch;

the system of valves including a first flow control valve located within the booster compressor branch upstream of the inlet of the booster compressor, a second flow control valve located within the bypass branch, a third valve located in the recycle branch and two valves located in the booster compressor branch and the bypass branch, respectively positioned downstream of the outlet of the compressor and the recycle branch and upstream of the second control valve and configured to prevent a reversal of flow in the booster compressor branch when bypass branch pressure within the bypass branch exceeds that of booster compressor branch and the reversal of flow in the bypass branch when booster compressor branch pressure at the outlet of the booster compressor exceeds that of the bypass branch; and a programmable control system configured to generate control signals to control valve opening of the first flow control valve, the second flow control valve and the third valve and to activate the booster compressor and responsive to selective user input to selectively introduce the compressed refrigerant air stream into the booster compressor branch and the bypass branch, the programmable control system programmed such that:

when the compressed refrigerant air stream is introduced into the booster compressor branch, the first flow control valve gradually opens and the second flow control valve gradually closes to gradually divert the compressed refrigerant air stream from the bypass branch to the booster compressor branch and thereby introduce the compressed refrigerant air stream into the booster compressor branch, the booster compressor is activated, the third valve initially is set in an open position to allow flow of the recycle stream and thereafter, is reset from an open position to a closed position when the booster compressor pressure exceeds the bypass pressure; and when the compressed refrigerant stream is introduced into the bypass branch, the first flow control valve gradually closes and the second flow control valve gradually opens to gradually divert the compressed refrigerant air stream from booster compressor branch to the bypass branch and thereby introduce the compressed refrigerant air stream into the bypass branch, the third valve is reset in from the closed position to the open position and the booster compressor is deactivated when the bypass pressure exceeds the booster compressor branch pressure.

2. The apparatus of claim 1, wherein:

the constant speed turboexpander is positioned between a location of a main heat exchanger having an intermediate temperature between warm and cold ends thereof and the distillation column system; and the branched flow path is positioned between the pre-purification unit and the main heat exchanger upstream of the constant speed turboexpander to receive a compressed refrigerant air stream.

3. The apparatus of claim 1, wherein the branched flow path has means for passing a purge air stream, composed of purified air, through the booster compressor after the booster compressor is deactivated to prevent ambient air from entering the booster compressor.

4. The apparatus of claim 1, wherein:

a conduit having an intermediate outlet connects the distillation column system to the main heat exchanger so that a liquid stream is removed from the distillation column system, is divided into a first subsidiary liquid stream discharged from the intermediate outlet and a second subsidiary liquid stream introduced into the main heat exchanger;

the at least one liquid product comprises the first subsidiary liquid stream;

the at least on liquid flow control valve is connected to the intermediate outlet;

the main heat exchanger is configured to heat the second subsidiary liquid stream to form a heated product stream; and the main air compressor has inlet guide vanes that are able to be adjusted to control air flow rate through the main air compressor and thereby decrease the air flow rate during the low mode of production to in turn maintain product flow rate of the heated product stream constant.

5. The apparatus of claim 4, wherein:

the distillation column system comprises a higher pressure column and a lower pressure column operating at a lower pressure than the higher pressure column, configured to further refine a crude liquid oxygen column bottoms produced in the higher pressure column and connected to the higher pressure column in a heat transfer relationship so that a nitrogen-rich vapor column overhead produced in the higher pressure column is condensed through indirect heat exchange with an oxygen-rich liquid produced in the lower pressure column, thereby providing liquid nitrogen reflux to the higher pressure column and the lower pressure column;

the liquid stream is an oxygen-rich liquid stream composed of an oxygen-rich liquid column bottoms produced in the lower pressure column;

the oxygen-rich liquid stream is divided into the first subsidiary liquid stream and the second subsidiary liquid stream;

a pump is positioned within the conduit to pressurize the second subsidiary liquid stream and thereby to produce a pressurized liquid product stream that is warmed within the main heat exchanger to produce the heated product stream;

means for forming a further compressed air stream is positioned between the pre-purification unit and the main heat exchanger;

the main heat exchanger is configured to liquefy the further compressed air stream and thereby form a liquid air stream;

the main heat exchanger is in flow communication with at least the lower pressure column to introduce at least part of a liquid air stream into the lower pressure column; and an expansion valve is positioned between the main heat exchanger and the lower pressure column to reduce pressure of the at least part of the air stream prior to introduction into the lower pressure column.

6. The apparatus of claim 5, wherein the constant speed turboexpander is connected to the higher pressure column such that the exhaust stream is introduced into the higher pressure column.

7. The apparatus of claim 5, wherein:

the main heat exchanger is positioned in flow communication with the pre-purification unit so that part of the air, after having been compressed and purified, is cooled within the main heat exchanger and introduced into the higher pressure column; and the constant speed turboexpander is connected to the lower pressure column so that the exhaust stream is introduced into the lower pressure column.

8. The apparatus of claim 5, wherein:

first and second booster compressors are in flow communication with the pre-purification unit so that first and second subsidiary streams, formed from at least part of a compressed and purified air stream discharged from the pre-purification unit, are further compressed in the first and second booster compressors, respectively and thereby respectively form the compressed refrigerant stream and the further compressed air stream;

the further compressed air stream forming means is the second booster compressor; and the booster compressor within the booster compressor branch is a third booster compressor.

9. The apparatus of claim 5, wherein:

a first booster compressor is in flow communication with the pre-purification unit so that at least part of a compressed and purified air stream is further compressed;

a second booster compressor and the branched flow path are connected to the first booster compressor so that a first subsidiary stream discharged from the first booster compressor forms the compressed refrigerant air stream and a second subsidiary stream discharged from the first booster compressor is further compressed in the second booster compressor to form the further compressed air stream;

the further compressed air stream forming means is the second booster compressor; and the booster compressor within the booster compressor branch is a third booster compressor.

10. The apparatus of claim 5, wherein:

a first booster compressor is in flow communication with the pre-purification unit so that at least part of a compressed and purified air stream is further compressed;

a second booster compressor is situated between the first booster compressor and the branched flow path and the main heat exchanger is in flow communication with the first booster compressor so that a first subsidiary stream discharged from the first booster compressor is further compressed in the second booster compressor and forms the compressed refrigerant air stream and a second subsidiary stream flow to the main heat exchanger and forms the further compressed air stream;

the first compressed air stream forming means is the second booster compressor; and the booster compressor within the booster compressor branch is a third booster compressor.

* * * * *